United States Patent [19]

Mummey et al.

[11] Patent Number: 4,984,383

[45] Date of Patent: Jan. 15, 1991

[54] DUAL ACTION OPERATING MECHANISM FOR A PLUGBOARD SYSTEM

[75] Inventors: Dale B. Mummey, Camp Hill; Brent D. Yohn, Newport, both of Pa.

[73] Assignee: AMP Incorporated, Harrisburg, Pa.

[21] Appl. No.: 494,560

[22] Filed: Mar. 16, 1990

[51] Int. Cl.[5] ..... H01R 13/15

[52] U.S. Cl. ..... 439/259; 439/378; 439/342

[58] Field of Search ..... 439/299, 342, 343, 372, 439/54, 51, 259, 261, 262, 266, 267, 269, 264, 374, 378

[56] References Cited

U.S. PATENT DOCUMENTS

| | | | |
|---|---|---|---|
| 3,419,842 | 12/1968 | Taylor, Jr. | 439/51 |
| 3,539,970 | 11/1970 | Lockard et al. | 439/342 |
| 4,134,631 | 1/1979 | Conrad et al. | 439/342 |
| 4,329,005 | 5/1982 | Bradginetz et al. | 439/51 |
| 4,377,318 | 3/1983 | Long | 439/51 |
| 4,542,951 | 9/1985 | Mummey et al. | 339/75 M |
| 4,664,456 | 5/1987 | Blair et al. | 339/14 P |
| 4,887,976 | 12/1989 | Bennett et al. | 439/492 |

OTHER PUBLICATIONS

AMP Catalog 85-766 "CR Connector Systems-Zero Insertion Force", pp. 1-7, 21-26, AMP Inc. Hbg. Pa.

AMP Catalog 73-227 "AMP Universal Patchcord Programming Products", pp. 1-9, AMP Incorporated, Hbg. Pa.

AMP Instruction Sheet IS 6687, "AMP Canned Rectangular (CR) 520 & 1040 Zero-Entry Force Connectors", Jul. 20, 1987, AMP Inc. Hbg. Pa.

AMP Instruction Sheet IS 7669, "AMP CR Series Standard Zero-Entry-Force 120-Position Connectors", Aug. 3, 1987, AMP Inc. Hbg. Pa.

AMP Technical Paper P261-82, "Design Considerations for High Pin Count Cammed Rectangular Zero Insertion Force Connectors", Smith, Nov. 1-2, 1982, AMP Inc. Hbg. Pa.

*Primary Examiner*—David L. Pirlot

*Attorney, Agent, or Firm*—Anton P. Ness

[57] ABSTRACT

An operating mechanism has dual action control in both the axial and normal directions described for a plugboard system or the like to connect and disconnect selective electrical terminals in housing modules of a front bay with respective electrical terminals in housing modules of a rear bay. The dual action operating mechanism moves the front bay relative to the rear bay in a straight inward direction thereby electrically connecting selective electrical terminals of the front and rear bays together; and a subframe of the rear bay is moved a preselected distance by the mechanism in a normal direction to apply a contact force to connect other selective electrical terminals of the front and rear bay.

30 Claims, 15 Drawing Sheets

62
112
34
48
48
77
56
76
170
168
57
44
108
170
168
112
48
48

62
112
34
48
48
77
56
170
168
57
76
44
108
112
170
168
48
48

62
112
34
48
48
164
163
166
B
161
71
51
112
44
70
71
161
50
108
48
48

DUAL ACTION OPERATING MECHANISM FOR A PLUGBOARD SYSTEM

FIELD OF THE INVENTION

This relates to the field of electrical connections and more particularly to mechanical systems for connecting and disconnecting arrays of electrical terminals.

BACKGROUND OF THE INVENTION

Plugboard systems are generally used in conjunction with computers to facilitate the connecting and disconnecting of arrays of electrical terminals. These plugboard systems are generally comprised of a stationary rear bay of electrical terminals and a movable front bay of electrical terminals. The rear bay usually contains coaxial connectors, signal contacts and power contacts that are arranged in rows or columns and are connected to associated electronic circuits. These circuits can be interconnected by corresponding coaxial connector and contact patchcords selectively arranged in holes in the movable front bay. When the front bay is moved as a unit relative to the rear bay from an inoperative position to an operative connecting position, the coaxial connectors, signal contacts and power contacts in the front bay are electrically connected with respective coaxial connectors, signal contacts and power contacts in the rear bay.

Generally, the electrical terminals are the type that axially connect with each other, such as for example pins and sockets; thus the front bay must be moved straight toward and away from the rear bay during the connecting and disconnecting of the coaxial connectors, signal and power contacts. Electrical terminals for flat power cable, such as those described in U.S. Pat. No. 4,887,976, are also axially connected. The electrical terminals may be mounted in dielectric housings which are then mounted to the framework of the front and rear bays, thus defining modular arrangements facilitating programming and service and repair.

A large number of connectors is involved in these plugboard systems which results in substantial mechanical resistance when the connectors are connected and disconnected. An operating mechanism is therefore required that can effectively connect and disconnect the connectors and precisely guide the connectors into electrical engagement without damaging the connectors over repeated operations thereby assuring optimum electrical continuity between the interconnected bays.

Operating mechanisms are known for plugboard systems to connect and disconnect the electrical terminals of the front bay with respective electrical terminals of the rear bay. In one such system disclosed in U.S. Pat. No. 4,542,951, the operating mechanism comprises hanger plates and sliding cam plates mounted on opposite side members of a rear frame of the rear bay, and the cam plates have profiled cam slots and L-shaped slots therein. An operating member, including a shaft with an actuator lever arm at one end, is pivotally mounted into the rear frame and includes rollers which are disposed in the L-shaped slots. When the operating member is moved from one position to another position, the rollers move along the L-shaped slots causing the cam plates to move linearly vertically along the sides of the rear frame. This causes the cam slots to move linearly horizontally support members on a front frame thereby connecting or disconnecting the electrical terminals in a relative axial movement.

Electrical terminals are also known in which the electrical contacts of each of the terminals being connected are first moved axially to be side-by-side with each other with substantially little or no engagement when the connectors are moved together. Then, the contacts of the terminals are moved laterally against each other in a wiping action caused by a camming arrangement in one of the connectors to generate the preselected normal force between the respective contacts to establish assured electrical connection therebetween. Such arrangements are known as "zero-insertion force" or ZIF connectors, and the contacts are blade shaped cantilever beams at least one of which is slightly deflected by the other to a spring loaded mated position against the other upon camming. Such ZIF style contacts and their actuation is disclosed in U.S. Pat. No. 4,664,456 and also in AMP Technical Paper No. P261-82, "Design Considerations for High Pin Count Cammed Rectangular Zero Insertion Force Connectors" (1982).

One such ZIF connector is a CR ZIF connector system sold by AMP Incorporated, Harrisburg, Pennsylvania and described in AMP Instruction Sheet No. IS 6687 (1987). The connector is a cammed rectangular connector having either 520 or 1040 mating pairs of terminals. Within a first one of the plug and receptacle framework assemblies are disposed a plurality of dielectric housing modules each containing a plurality of contacts. The modules are fixedly mounted to a common subframe within a first framework assembly. Also disposed within the assembly is another housing containing conventional pin-and-socket contacts, the housing being fixedly mounted within the cover. The assembly includes a cam which when actuated moves the subframe and its fixedly mounted modules in the common lateral direction, but which does not move the fixedly mounted housing. The first framework assembly is axially mated with the mating second framework assembly, the modules upon being cammed urge the contacts secured therein against now adjacent mating contacts of the mating second assembly so that the contacts are deflected against spring bias to establish sufficient normal force against the connecting contacts.

Also sold by AMP Incorporated is a ZIF connector having one or a few housing modules containing male or female terminals requiring axial mating, and one or a few housing modules containing ZIF-style contacts requiring lateral mating after being moved side-by-side. This cammed rectangular system is described in AMP Instruction Sheet No. IS 7669 (1987). All of the housing modules are disposed within a pair of mating assembly covers: in the active cover the modules containing axial mating terminals are fixedly mounted, and the modules containing the ZIF-style terminals are float mounted; in the mating cover the mating connector modules are fixedly mounted. The active cover includes a cam which when manually actuated such as by rotation moves the float mounted housing modules in a common lateral direction. During mating of the assembles, the float mounted housing modules upon being cammed urge the ZIF-style terminals secured therein against adjacent contacts of the mating assembly so that the contacts are deflected against spring bias to establish sufficient normal force against the mating ZIF-style contacts.

Conventionally, separate plugboard systems have been used with separate operating mechanisms for each type of electrical connector and required movement, either axial or normal, but not both. These prior art operating mechanisms for plugboard systems do not presently and cannot be easily adapted to provide both axial movement to connect plugboard systems having pin and socket electrical terminals (such as power contacts, coaxial connectors, and signal contacts), and normal movement for "zero force connectors." While pin and socket and other types of electrical connectors need a substantial axial force to mate a front and rear bay having large numbers of electrical terminals, zero force connectors need a very precise normal movement to bias contacts of the mating assembly to a predetermined contact. Having separate mechanisms for each type of movement within one framework, however, is not fully satisfactory because one or more plugboard systems may need to be used within a very limited space. Also, this solution creates wiring harness complications, particularly if various types of electrical connectors need to be used.

SUMMARY OF THE INVENTION

The operating system described below for a plugboard system or the like comprises a frame on the rear bay having a subframe which is mounted in a floating position. Various types of electrical terminals are secured in dielectric housing modules in a row along the subframe. The subframe includes top and side members and engaging means secured in dielectric housing modules positioned near each side member. Hanger plates are located on the opposite side members of the frame on the rear bay in alignment with each other. The hanger plates include guide slots which serve to receive respective support members extending outwardly from side members of the frame of the front bay. Sliding cam plates are mounted on the frame of the rear bay along the hanger plates and have spaced profiled cam slots formed therein. The cam slots have entrance sections extending parallel to the straight guide slots, angled sections and straight sections disposed normal to the entrance sections. Each of the cam plates has a first matched elongated slot disposed generally along an axial direction and a second matched elongated slot disposed generally at normal position to the first slot.

An operating member is mounted onto the frame of the rear bay to move the cam plates in unison relative to said hanger plates between an inoperative position, an intermediate position, and an operative position. The operating member includes a shaft extending through each of the side members, and arms are secured to the shaft near the side members and have bearing means attached thereon. The bearing means engages the generally axially aligned slot of the cam plate. When the operating member is moved from the inoperative to the intermediate position, the shaft rotates to move the bearing means in engagement with the sliding cam plates so that the support members positioned in the respective guide slots of the hanger plates are moved along the side members of the frame of the rear bay causing the angled sections and the straight sections of the cam slots to move the support members along the guide slots in a straight inward direction thereby electrically connecting the respective male and female electrical terminals of the front and rear bays together.

As the operating member is moved from the intermediate position to the operative position, the cam plates continue normal movement engaging the engaging means of the rear subframe and moving it a predetermined distance. A selected level of spring bias force is thereby obtained between the mating ZIF style electrical terminals of the front and rear bays which establishes a desired level of contact normal force therebetween. The modules containing electrical terminals are either float mounted or fixed mounted within the subframe such that when the preselected force is applied, the terminals of the float mounted modules remain secured via the axial mated connection with corresponding front bay terminals. The subframe moves vertically relative to these axially mated terminals and the terminals of the fixedly mounted modules are moved vertically relative to corresponding front bay terminals and are mated to a desired level of contact normal force.

DETAILED DESCRIPTION OF THE INVENTION

Figure 1:
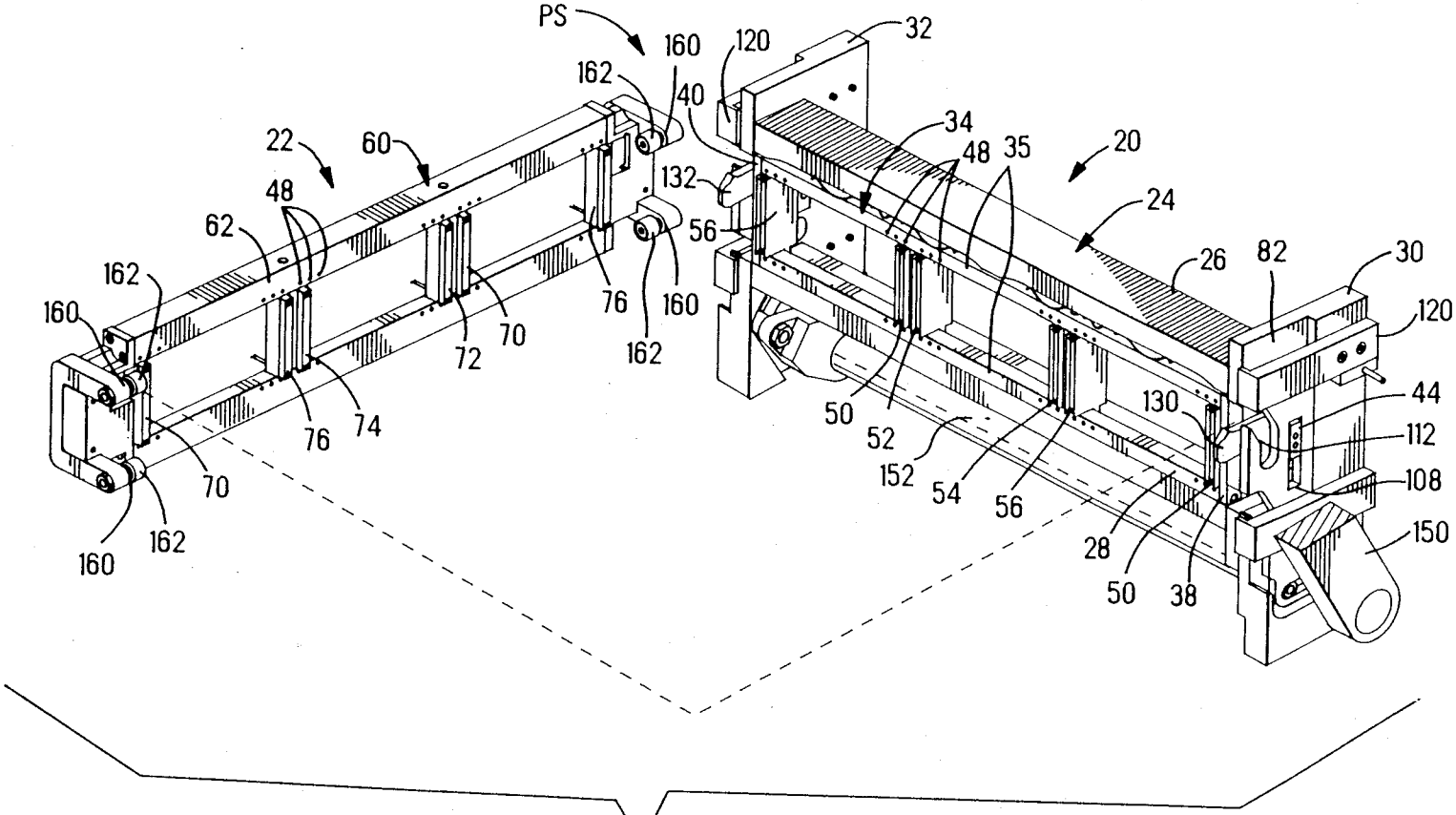
FIG. 1 is a perspective view of a plugboard system with the front bay exploded at right angles to the rear bay.

A plugboard system PS is shown in FIG. 1 which includes a rear bay 20 and a front bay 22. Rear bay 20 includes a frame 24 that contains a top member 26, bottom member 28 and side members 30, 32.

Figure 3:
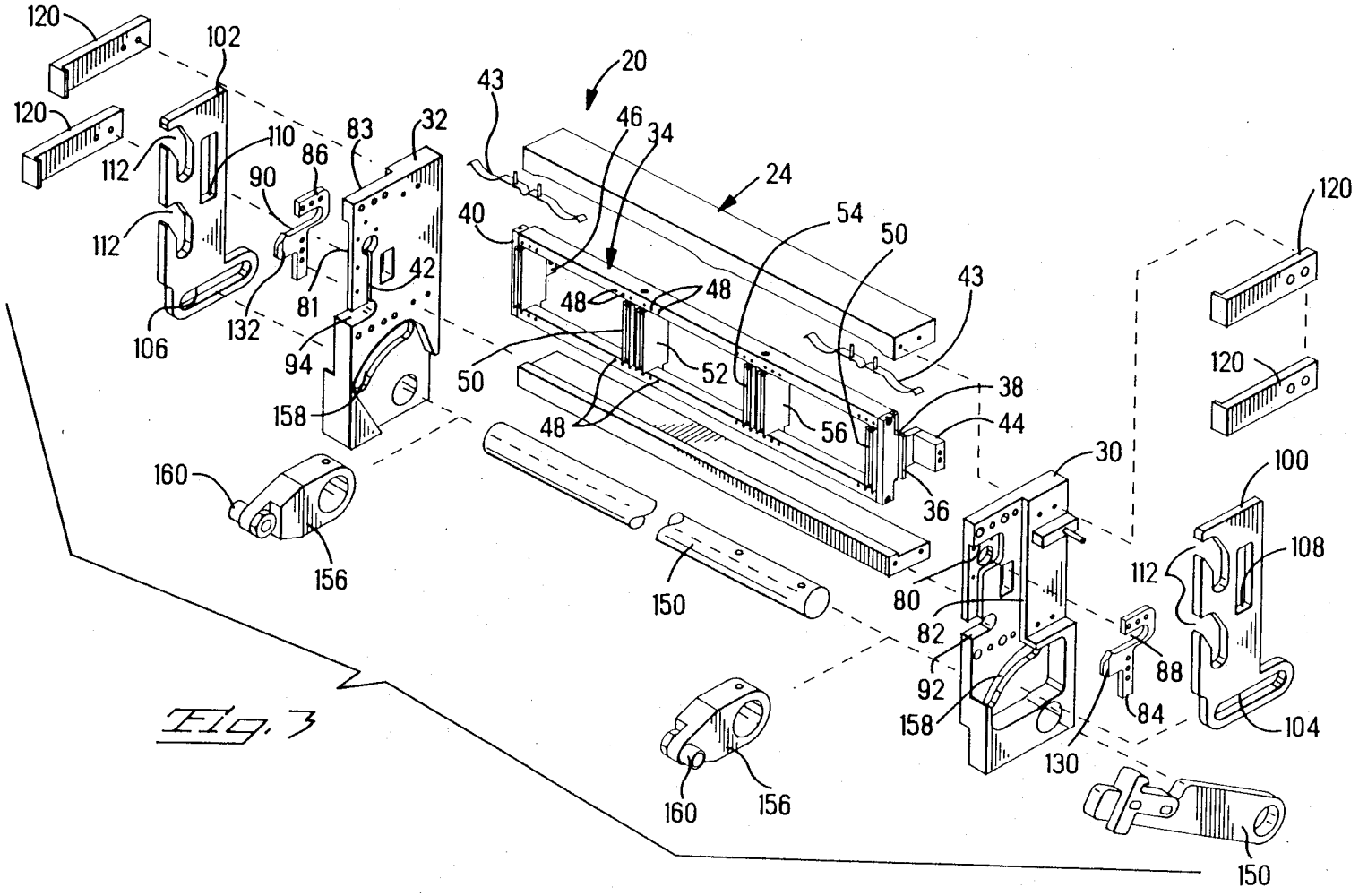
FIG. 3 is an exploded and perspective view of the parts of the dual action operating mechanism of the system of FIG. 1.

A subframe 34 or panel, which includes an array of dielectric blocks, is secured in a floating manner in a normal direction by normal guide means, such as tongues 36 formed on the side members 38 and 40 of the subframe 34 and grooves 42 formed on the side members 30, 32 of the rear bay frame 24 (FIG. 3). If needed for positive bias, springs 43 or the like may be positioned between the top of the frame 24 and subframe 34 to assure a correct initial subframe position when the front and rear bays 22, 20 are separated.

As shown in FIG. 3, the subframe side members 38, 40 each have extending arms 44, 46 or the like which are used by the operating mechanism to position the subframe 34. The subframe 34 has rows of holes 48 therethrough for fasteners by which modular dielectric blocks 50, 52, 54 and 56 are secured as shown in FIGS. 1 and 3. Continuing vertical columns of electrical terminals of the pin-and-socket type, such as those in modules 50 are used for conducting power. Also, modules 52 contain terminals of the coaxial plug and receptacle type which may be used for conducting high frequency signals; modules 54 contain terminals of the leaf spring type which may be used for conducting lower frequency signals; and zero-insertion force or ZIF terminals in modules 56 may be used for signal interconnection. Depending on the type of terminal, the mounting of the terminal modules to subframe 34 of rear bay may be either fixed or floating with respect to the subframe 34, which is itself mounted to float in the rear bay 20 as described above. For example, as shown in FIGS. 7–11, an electrical ZIF module 56 is fixedly mounted, and as shown in FIGS. 12–16, power terminal modules 50 are float mounted in the subframe 34.

Front bay 22 includes a frame 60, in which is secured a dielectric panel 62, having rows of holes 48 therethrough for fasteners by which are secured complementary electrical terminal modules 70, 72, 74, and 76. As shown in FIGS. 7–16, their terminals electrically connect with respective electrical terminals of modules 50, 52, 54, and 56 when front bay 22 is moved in a straight or axial direction toward rear bay 20 and rear bay 20 is moved in a normal direction. To disconnect the terminals, the rear bay 20 is moved in a reverse normal direction and front bay 22 is moved away from rear bay 20 via an operating mechanism which will be described in greater detail hereinafter.

Figure 2:
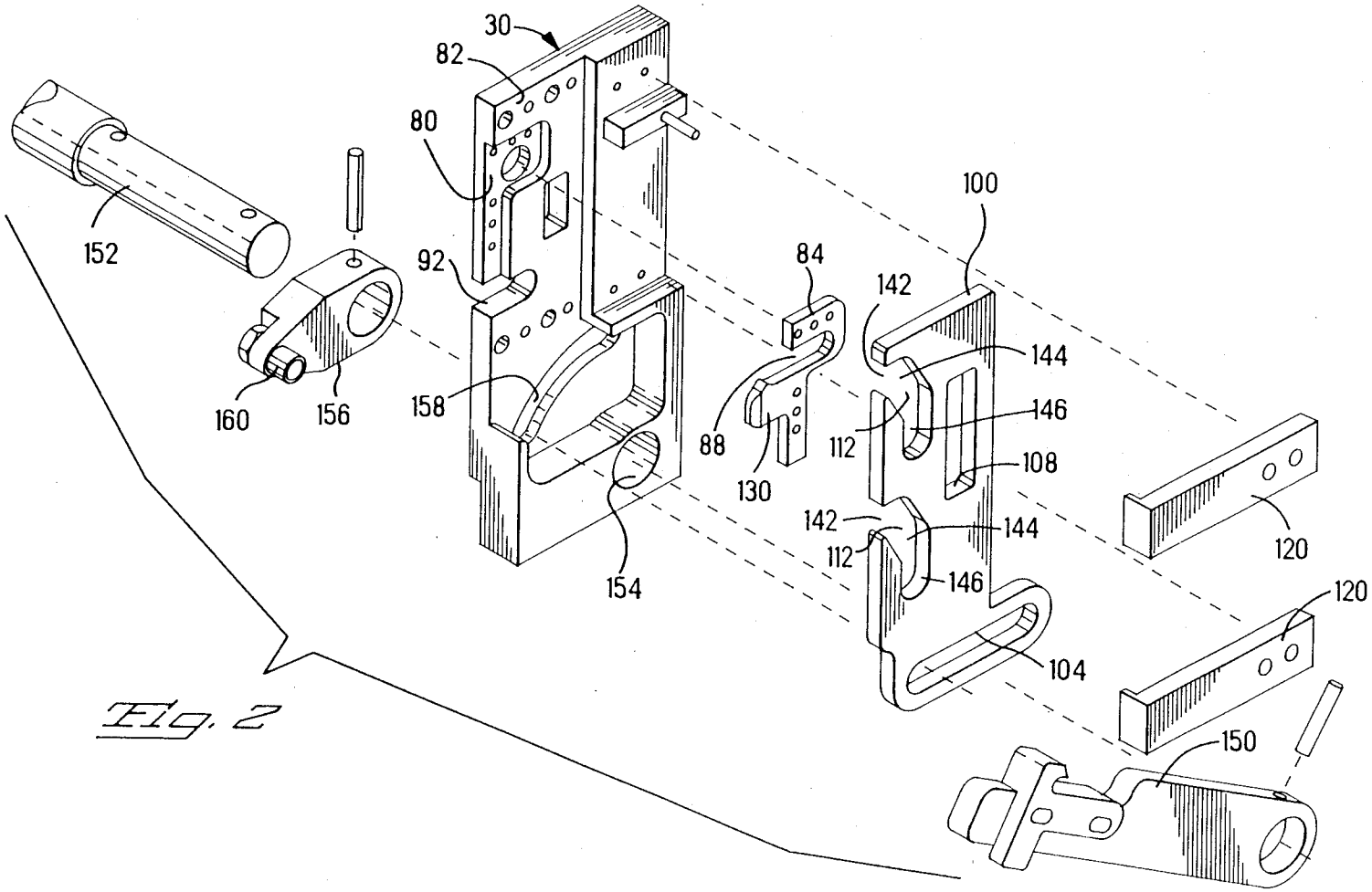
FIG. 2 is an exploded and perspective view of the parts of one section of the dual action operating mechanism of the system of FIG. 1.
Figure 4:
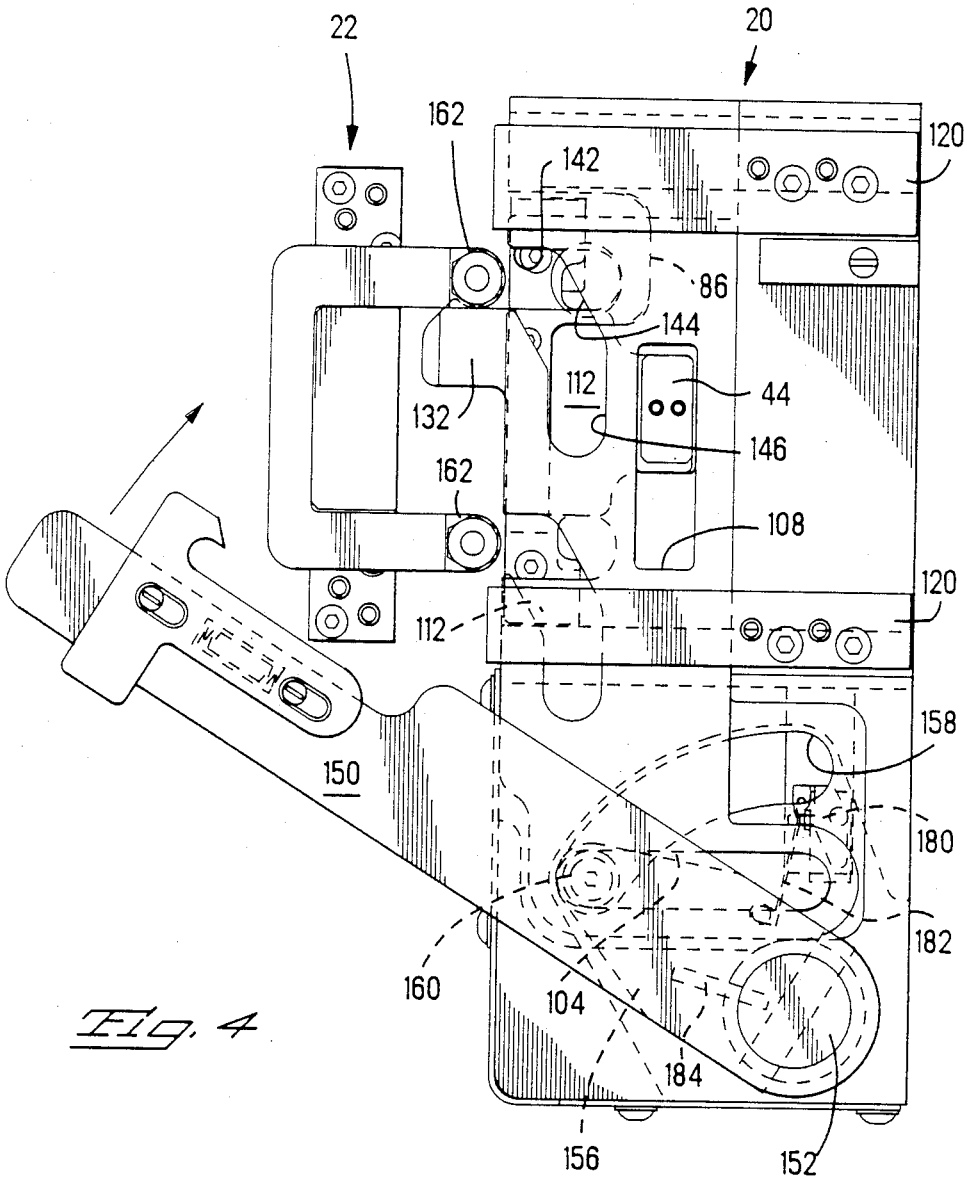
FIGS. 4, 5, and 6 are part side elevational views of the plugboard system of FIG. 1 illustrating the operation of the dual action operating system.
Figure 5:
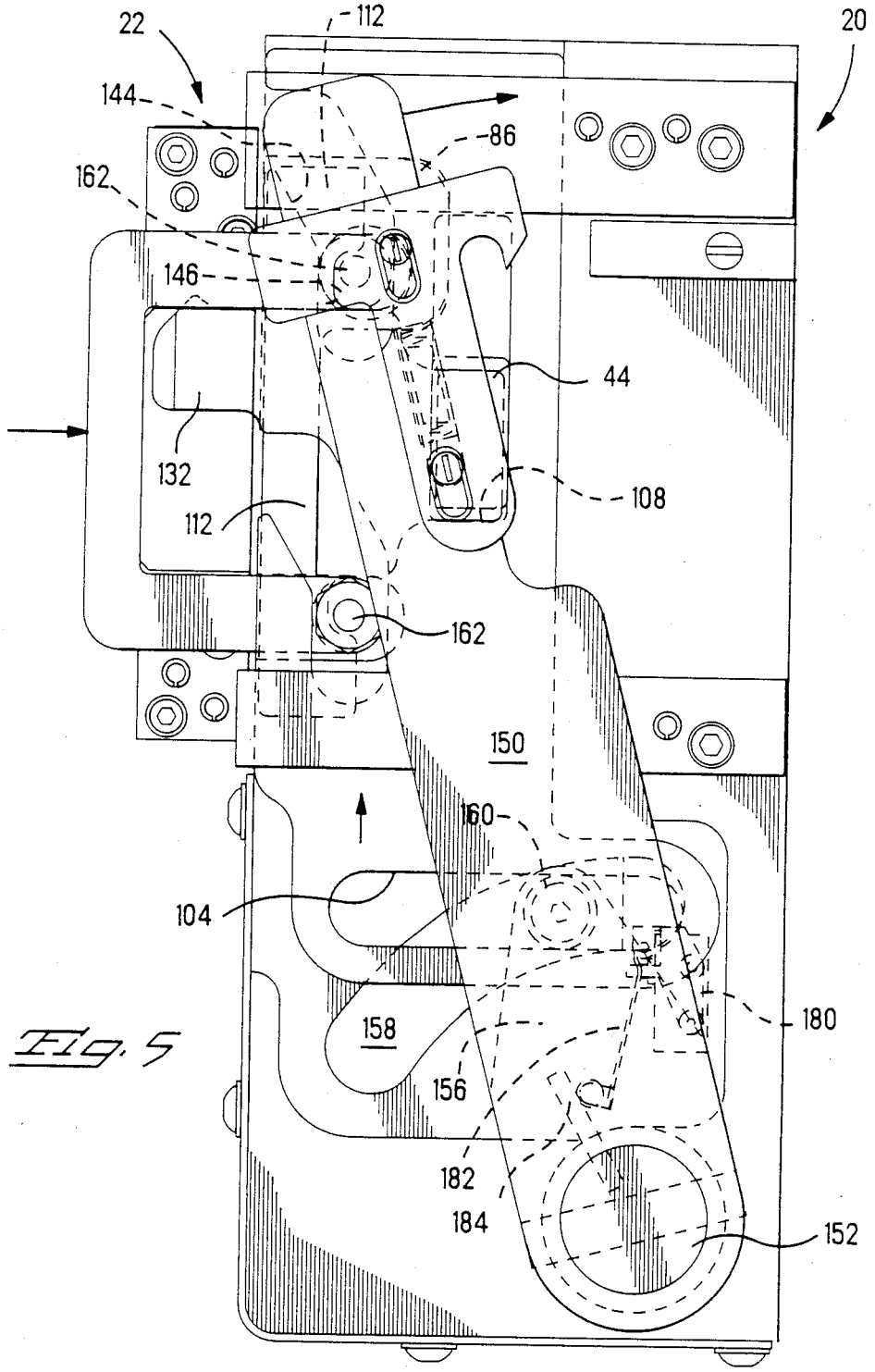
Figure 6:
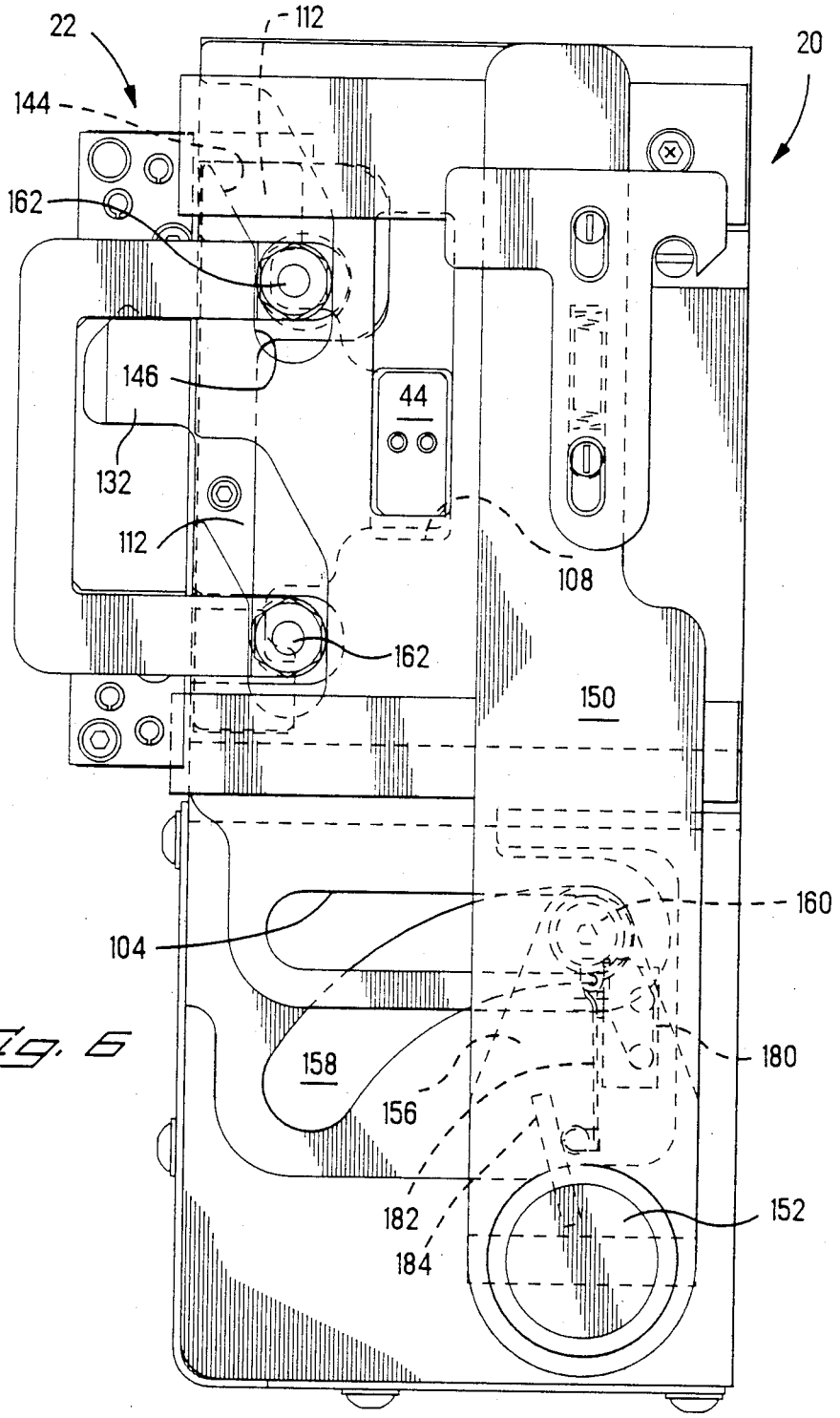

FIGS. 2 and 3 show the details of the operating mechanism and FIGS. 4, 5, and 6 illustrate the operation thereof. Side members 30, 32 of rear frame 24 have first recesses 80, 81 and second recesses 82, 83. Hanger plates 84, 86 are secured in the first recesses 80, 81 and are provided with straight guide slots 88, 90 or recesses that extend inwardly along side members 30, 32 toward the rear ends thereof. Straight guide slots or recesses 92, 94 are also located in side members 30, 32 which are parallel to guide slots 88, 90. Hanger plates 84, 86 include portions 130, 132 which extend outwardly from the front surfaces of side members 30, 32 (FIGS. 1 and 4). Hanger plates 84, 86 are also flush with the inside surfaces of side members 30, 32.

Sliding cam plates 100, 102 are positioned in the second recesses 82, 83 of side numbers 30, 32 have an engageable cam surface and an actuating surface, i.e. first and second oblong openings respectively 104, 106, and 108, 110 which are disposed generally normal to each other. Mounting plates 120 are secured onto the outside surfaces of side members 30, 32 via screws or the like to control movement of the sliding cam plates 100, 102.

A front cam engageable surface is defined by cam slots 112 in sliding cam plates 100, 102 which have entrance sections 142, angled sections 144 and straight sections 146 which are disposed normal to entrance sections 142. Entrance sections 142 are disposed parallel with respect to respective guide slots 88, 90, 92, and 94. A coupler, such as subframe arms 44, 46, extend through side members 30, 32 and are positioned to be within second oblong openings 108, 110 of the sliding cam plates 100, 102.

A lever 150 is secured to a shaft 152 that extends through openings 154 in side members 30, 32. An arm 156 is secured onto shaft 152 at each end thereof and is disposed through arcuate slot 158 in side members 30, 32 so as to be movable therein. Roller bearing members 160 are secured to the respective ends of arms 156 and they are respectively disposed in the first oblong openings 104, 106 of cam plates 100, 102. When lever 150 is moved from one position to another, bearing members 160 move along the first oblong openings 104, 106. This causes sliding cam plates 100, 102 to reciprocally move along the second recesses 82, 83 and mounting plates 120. This movement causes cam slots 112 to move in a direction along the straight sections 146 of cam slots 112. Roller bearing members 160 move smoothly and with reduced friction within the first oblong openings 104, 106. When cam plates 100, 102 move under the action of bearing members 160 along the first oblong openings 104, 106, cam plates 30, 32 move relative to shaft 152.

Support members 162 are mounted on the inward sides of front frame 60 of front bay 22. They are in the form of pairs of sleeve or roller bearing members 160 and the inner surfaces of the bearing members are spaced apart at a preselected distance to position the front frame 60 in correct alignment with the rear frame 24.

Forwardly projecting hanger arms 130, 132 extend forwardly of the frame of the rear bay 20 to receive the corresponding support members 162 of the front bay 22 during initial stages of mounting the front bay 22 onto the rear bay 20. Front bay 22 is then pushed inwardly so that support members 162 move into entrance sections 142 of cam slots 112 until they engage the rear surface of angled section 144. Lever 150 is then moved from an inoperative position (FIG. 4) to an intermediate position (FIG. 5) in an inner direction causing shaft 152 and arms 156 to rotate and in so doing bearing members 160 of arms 156 are moved along the first oblong openings 104, 106 thereby moving sliding cam plates 100, 102 relative to side members 30, 32.

As shown in FIG. 5, this motion causes angled sections 144 and straight sections 146 of cam slots 112 to move along support members 162, which moves front bay 22 in a straight axial direction relative to rear bay 20. As shown in FIG. 4, the extending arms 44, 46 of rear subframe 34 are positioned away from any coupled engagement with the sliding cam plate 30, 32 when the lever 150 is in the inoperative position (FIG. 4) up to the intermediate position (FIG. 5).

Figure 7:
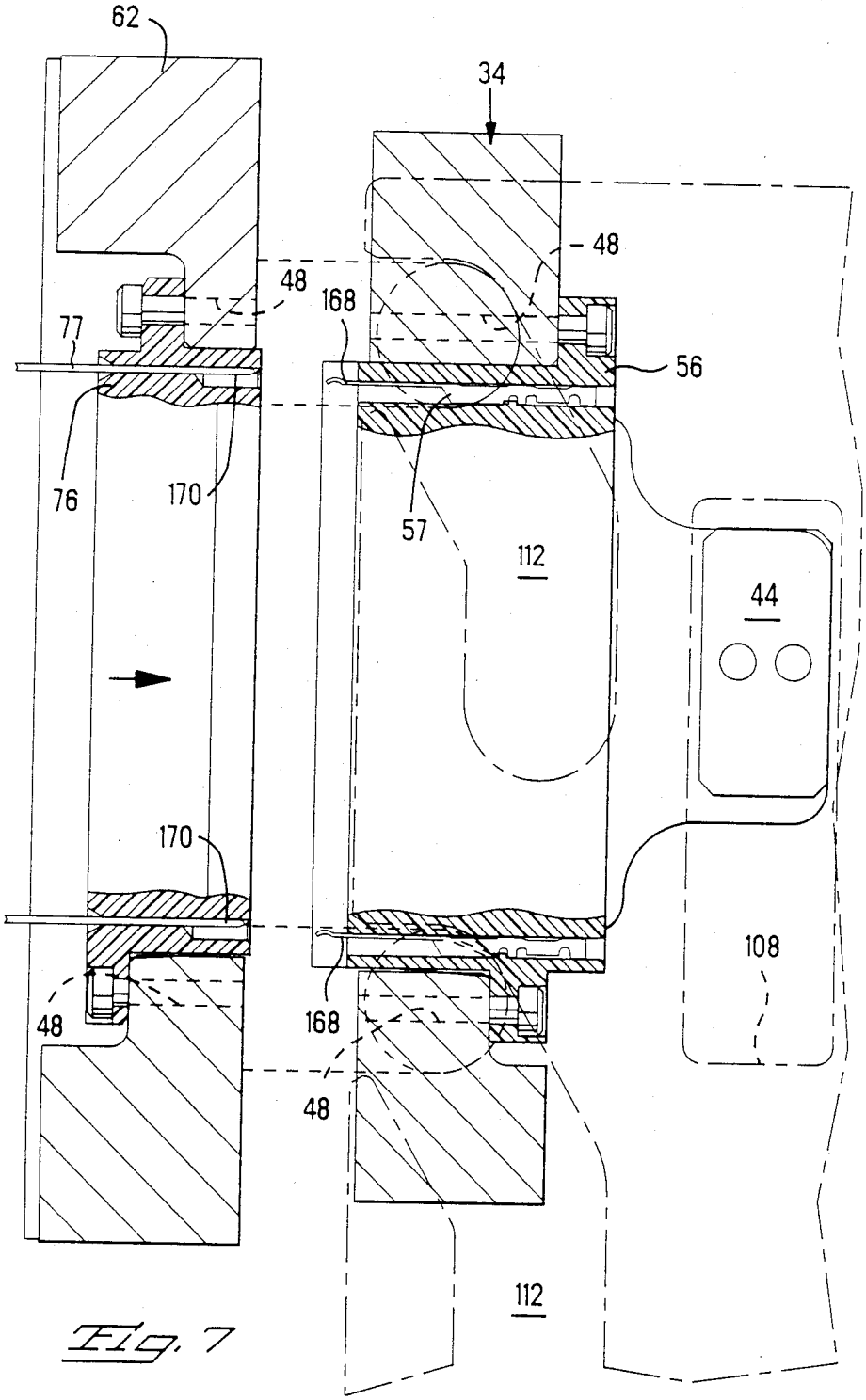
FIGS. 7, 8, and 9 are cross sectional side views of the ZIF style connectors of the system of FIG. 1 before and after engagement of the front and rear bays as the dual action operating mechanism moves from an inoperative, through an intermediate, to an operative position, respectively.
Figure 8:
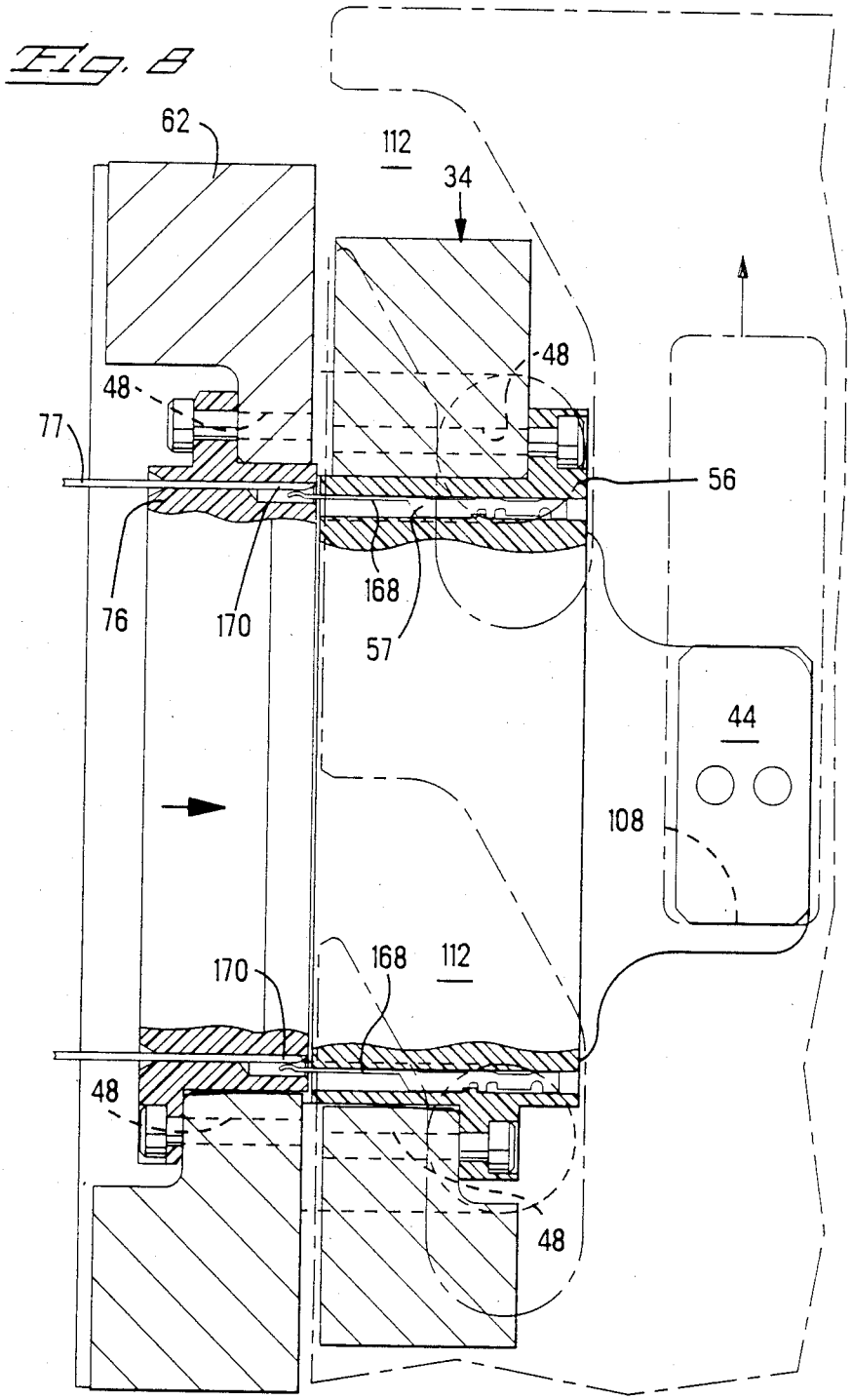

When lever 150 is moved to its intermediate position as shown in FIG. 5, the terminals 51 and 71 (FIGS. 12 to 16) of electrical power terminal modules 50, 70 are into electrical engagement with one another and terminals 57, 77 of ZIF modules 56, 76 are moved into an insertion position. As shown in FIGS. 7–8, the motion of the operating mechanism from the inoperative position (FIG. 7) to the intermediate position (FIG. 8), axially inserts the ZIF electrical terminals 57, 77 of modules 56,76 into the respective opposing modules 76,56 and along the corresponding terminals 77,57. The ZIF terminal modules 56 are each fixedly mounted to the subframe panel 34 of the rear bay 20.

Figure 12:
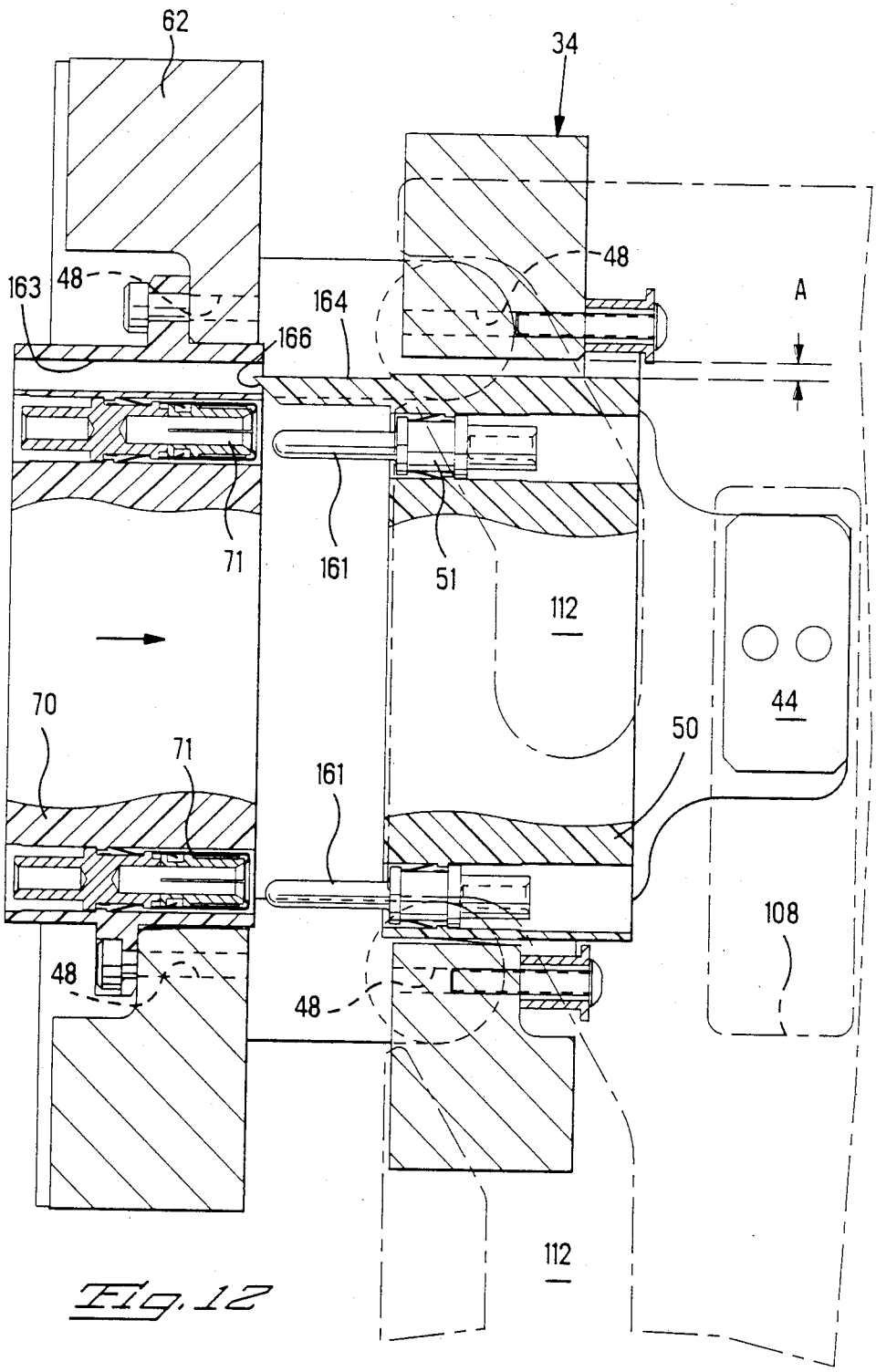
FIGS. 12, 13, and 14 are cross sectional side views of the pin and socket style connectors of the system of FIG. 1 before and after mating of the front and rear bays as the dual action operating mechanism moves from an inoperative, through an intermediate, to an operative position, respectively.
Figure 13:
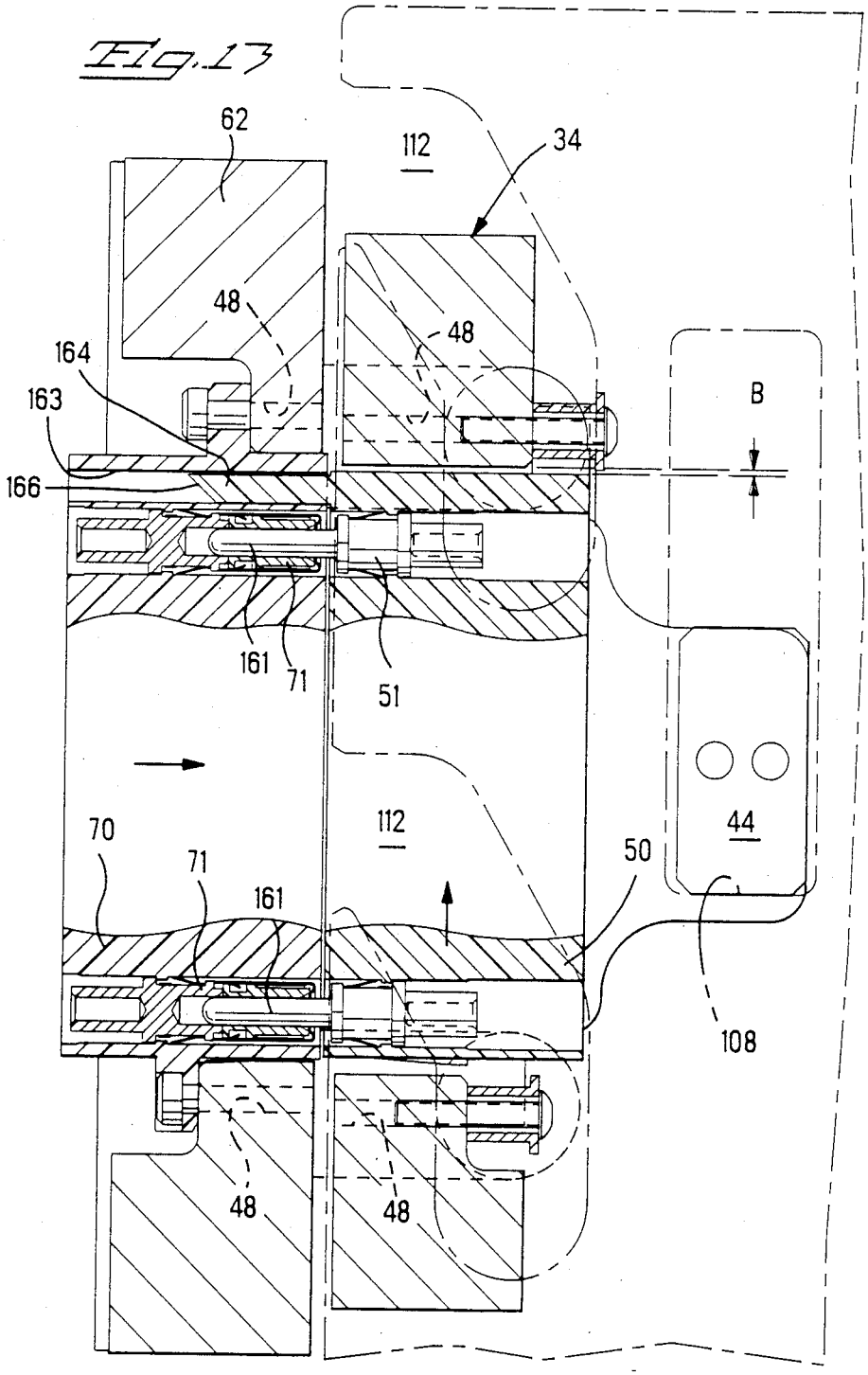
Figure 14:
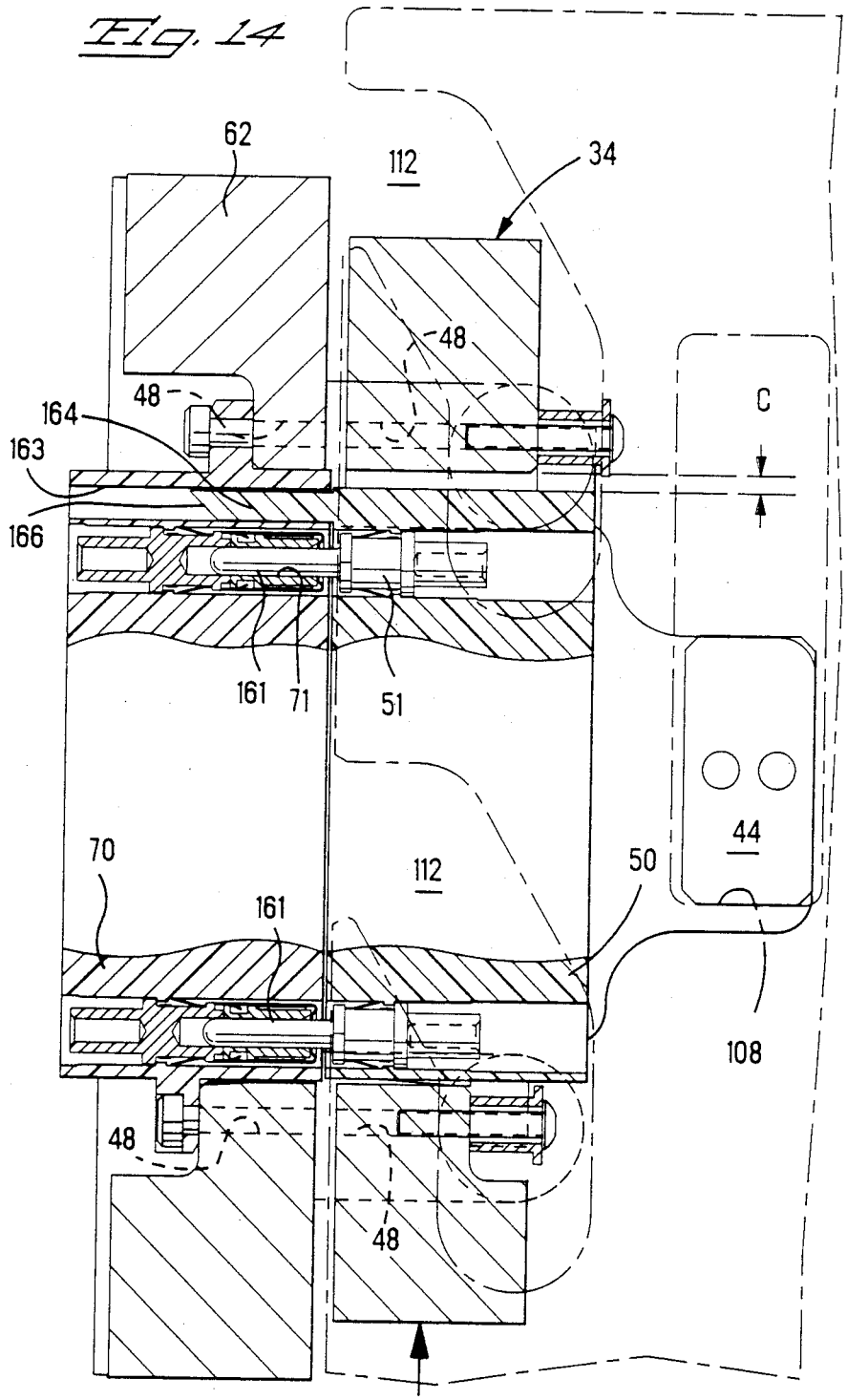

As shown in FIGS. 12–13, the power connector modules 50 are moved axially between the inoperative position of FIG. 12 and the intermediate position of FIG. 13 to electrically mate the pin 161 and socket of the terminals 51, 71 together. The power connector modules 50 in the subframe 34 are float mounted thereto to permit normal movement with respect to the subframe 34, which in turn is float mounted within the frame 24 of the rear bay 20 to permit normal movement with respect to both the front and rear bay frames 22, 20.

In this connection, a guide pin 164 having a cam surface 166 correctly positions the rear subframe guide pin 164 precisely within the corresponding pin-receiving aperture 163 of the mating module 70 mounted in the front bay by camming the float mounted rear subframe module 50 in a normal direction. This degree of camming movement of the guide pin 164 with respect to the subframe panel 34 is depicted by space A in FIG. 12 and the resulting space B in FIG. 13. At this intermediate stage of FIG. 13, while the electrical power terminal modules 50, 70 and other axially inserted terminals are electrically mated, the ZIF terminals 56, 76 are not.

Figure 9:
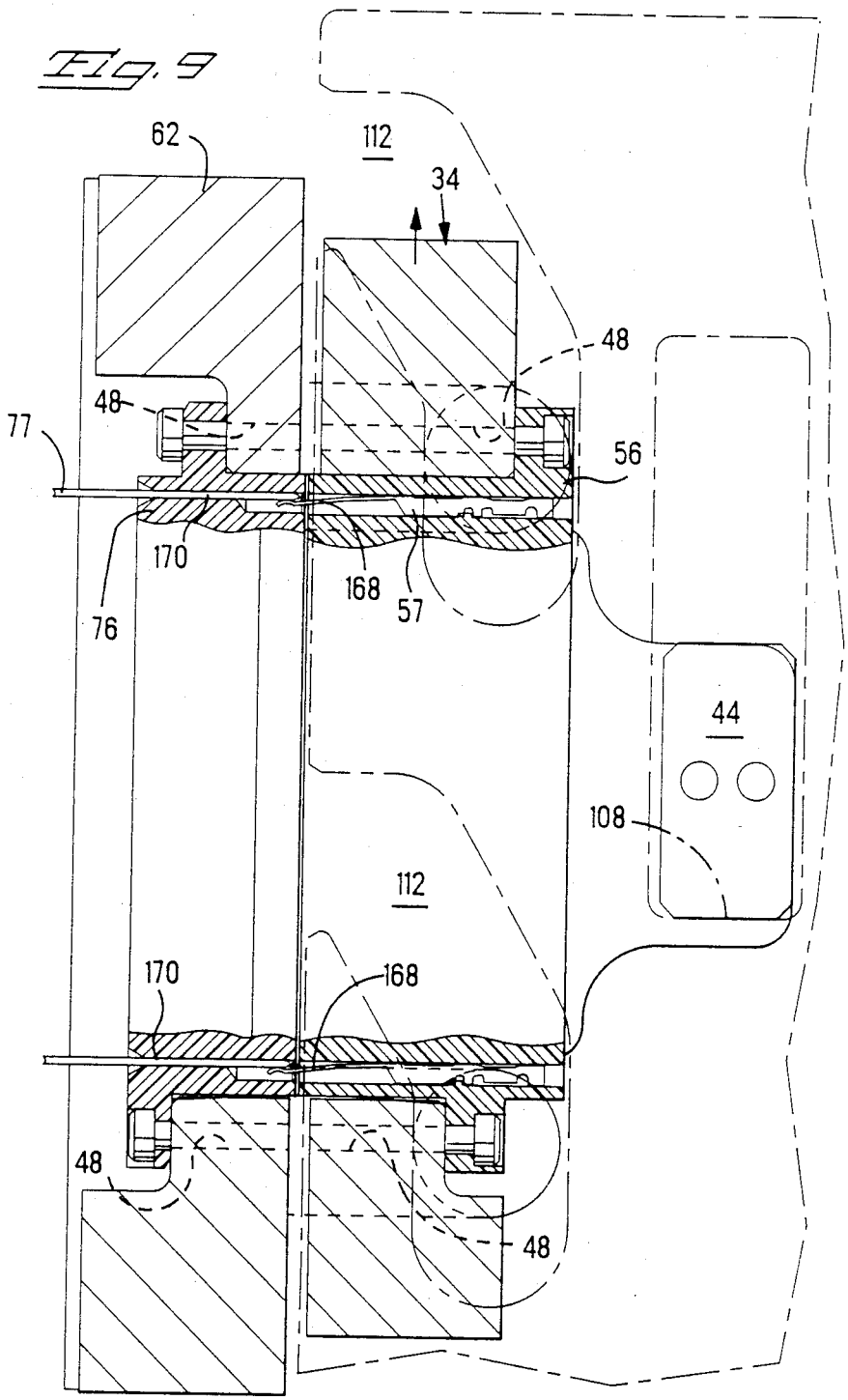
Figure 10:
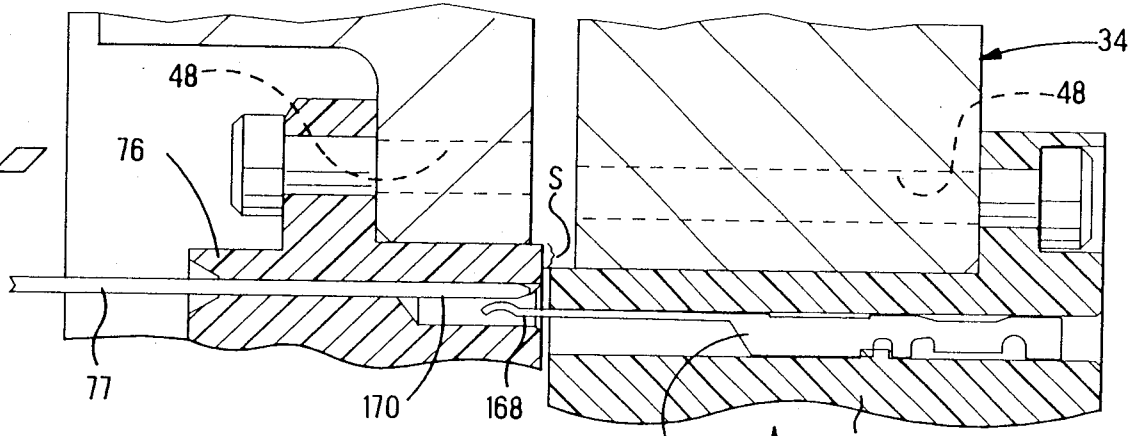
FIGS. 10 and 11 are enlarged views of selected ZIF style connectors of FIGS. 8 and 9, respectively.
Figure 11:
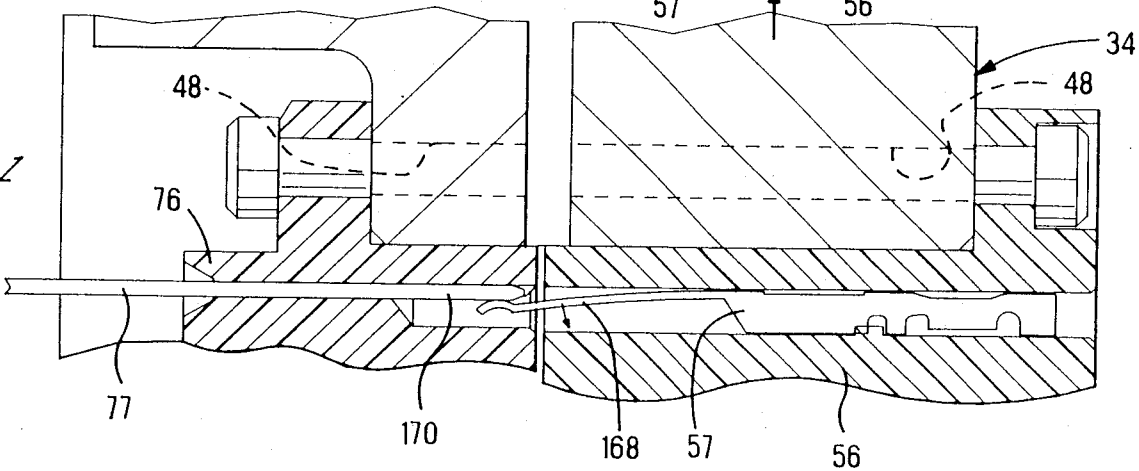

As shown in FIGS. 5–6, the continued movement of the lever 150 moves the operating mechanism from the intermediate position of FIG. 5 to a fully operative position of FIG. 6. As sliding cam plates 100, 102 move, a coupling action occurs as the arms 44 46 of the subframe 34 move the subframe 34 a predetermined distance "S" (FIG. 10) in a normal direction. Turning to FIG. 9, which shows the assembly in the operative position, the movement of the subframe 34 causes spring contact 168 to wipe against mating 170 to form an electrical connection of the ZIF terminals. In more detail, FIGS. 10–11 show the wiping action as the subframe 34 moves the predetermined distance S from the intermediate position (FIG. 10) to the operative position (FIG. 11) to wipe the spring contact 168 into electrical contact with mating contact 170.

Figure 15:
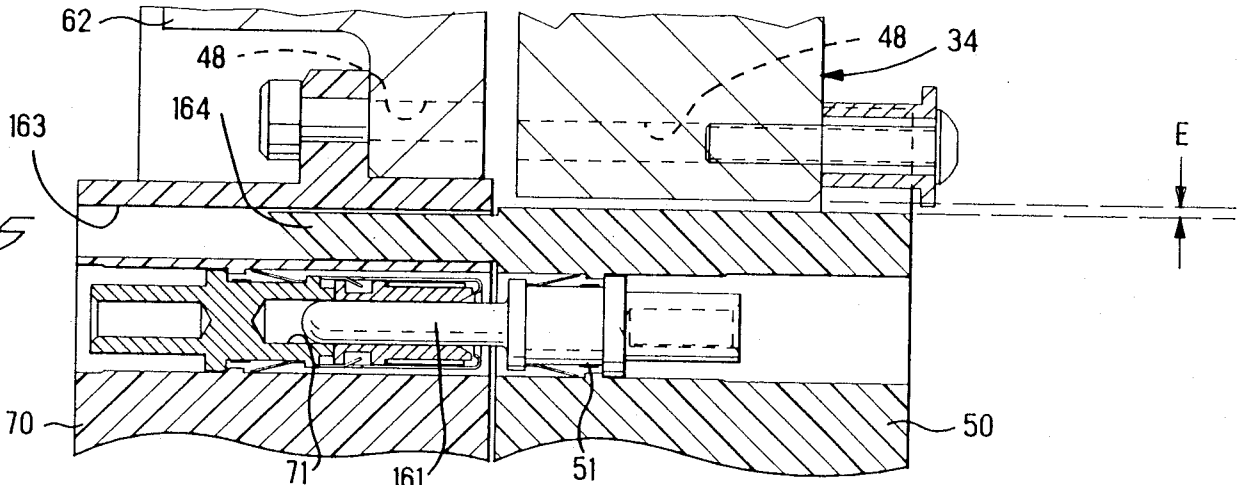
FIGS. 15 and 16 are enlarged views of the pin and socket connectors of FIGS. 13 and 14, respectively.
Figure 16:
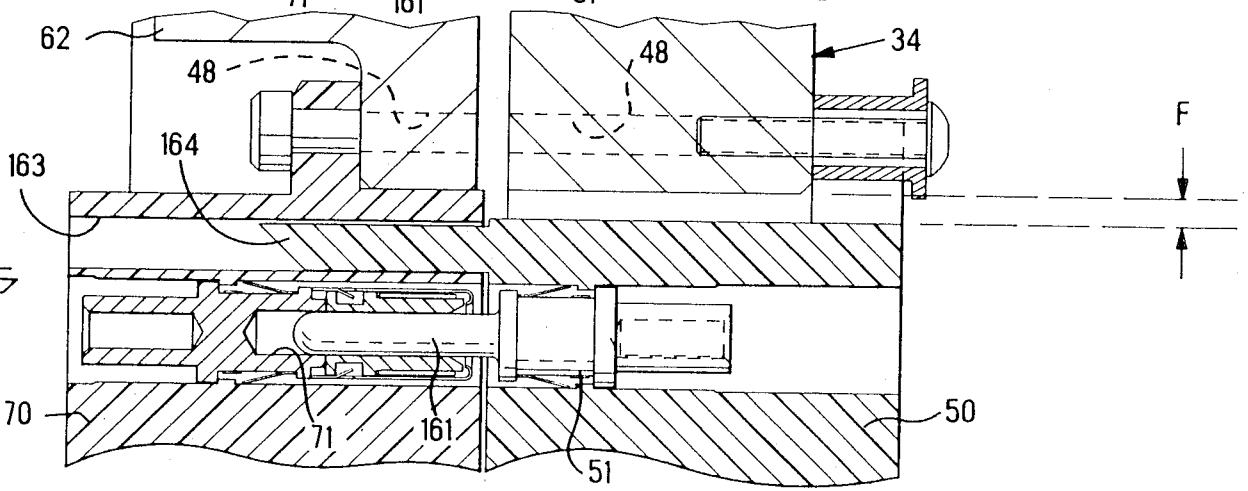

FIG. 13 shows the operating mechanism in the intermediate position and the floating electrical power modules 50 have been moved into a top float position and into electrical connection. As the operating mechanism moves to the operative position of FIG. 14, to the guide pin and aperture arrangement, and the plurality of pin and socket connections hold the pins 161 in the electrical module 50 in a fixed position so that the predetermined movement of the subframe 34 moves the subframe 34, but not the pin containing power modules 50. The stationary positioning of each pin 161 relative to corresponding socket terminal 71 assures continued electrical power connections. FIGS. 15 and 16 show respectively the movement of the subframe 34 from a spacing E in the intermediate position of FIG. 15 to a spacing of F in the operative position of FIG. 16.

The motion of the rear subframe 34 is controlled by guide means disposed between the subframe side members 30, 32 and the frame side members 38, 40. For example and as seen in FIG. 3, a tongue 36 on each of the subframe side members 38, 40 engaging a groove 42 in each of the subframe side members 38 is just one suitable guide means. The tongue and grooves could be reversed on the respective side members or other mechanical guide means selected.

Figure 17:
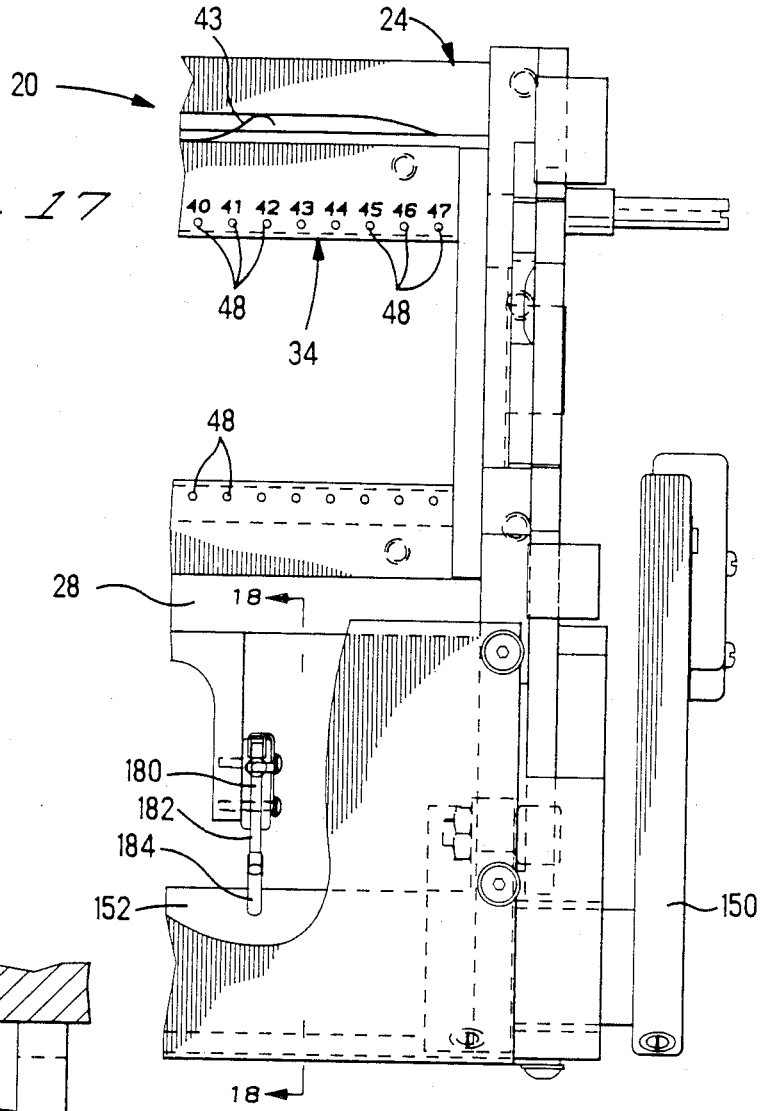
FIG. 17 is a partial front view of the operating mechanism of the system of FIG. 4 showing an interlock switch.
Figure 18:
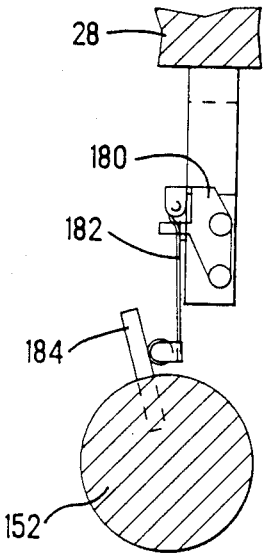
FIG. 18 is a partial side view of the interlock switch of FIG. 17.

Turning now to FIGS. 17 and 18, an electrical connection safety switch 180 is illustrated which prevents electrical current from flowing between the electrical terminals prematurely. Such current flow would cause arcing, heat and damage to the terminals, and could create inoperative terminals necessitating replacement. The safety switch 180 has an extending arm 182 which is engaged by a shaft extension 184 of the shaft 152. As best shown in FIG. 4, the switch is off when the operating mechanism is in the inoperative position. As the operating mechanism is moved to the intermediate position, the switch remains off. Only when both axial movement of the front bay 22 and normal movement of the rear subframe 34 has been completed does shaft extension 184 turn the switch on and allow flow of electrical current. In this manner, the electrical terminals are protected from damage.

When lever 150 is moved outwardly, a reverse operation to that described above takes place thereby causing the rear subframe 20 to move in a reverse normal direction and front bay 22 to move outwardly from rear bay 20 thereby disconnecting electrical modules 50, 52, 54, 56, and 70, 72, 74, and 76 from one another. Thus, the rear subframe 34 can be moved normally relative to the rear bay 20 and the front bay 22 can be moved in a straight direction towards and away from rear bay 22 to enable the electrical terminals to electrically connect and disconnect with one another in a precisely guided manner that takes place via an operating mechanism that operates smoothly with substantially reduced friction.

Variations on the embodiments described above are possible. For example, more than one front and rear bay can be electrically connected with one operating mechanism. The bays may be stacked one above the other and an extension and repeat of the operating mechanism features can easily connect two or more bays. If more connecting force is needed, then the lever can be simply extended. Similarly, sliding cam plates can also be extended to accept a second bay in the same manner as the above embodiment. It is also within the scope of the present invention to use the camming plates actuated by hydraulic means rather than manual rotation of a lever arm, so long as actuation of both camming plates is synchronized.

In another variation, straight sections 146 of cam slots 112 can be angled back toward the front of cam plates 100, 102 to subject the electrical terminals to a reverse wiping action.

In yet another variation, the subframe may be biased by other than springs. For example, a resilient material positioned between the frame and subframe may adequately bias the subframe. Further, when the plugboard system is positioned vertically as shown in FIG. 1, the force of gravity may bias the subframe relative to the frame.

In yet another variation, the subframe may be coupled to the sliding cam plate by other than the extending arms and second oblong opening. For example, sliding cam plates may have extending arms which engage a receiving slot in the subframe side member.

These embodiments described above provide a number of significant advantages. The operating mechanism of the present invention assures positive control of the front bay at all times so that different kinds of electrical terminals are electrically connected and disconnected with respective electrical terminals of the rear bay without damage thereto. A large number of electrical terminals of the front bay and the rear bay are connected and disconnected by use of the present operating mechanism even though substantial resistance is encountered during connecting and disconnecting the terminals. Moreover, the operating mechanism is of simplified construction and operates in a smooth manner with substantially reduced friction. Because some electrical terminals float in a normal direction on the subframe, which itself floats in a normal direction within the frame, and other terminals are fixed, one can selectively mix electrical terminals in a desired manner and easily can have both power and ZIF electrical terminals in the same plugboard system.

Of course, it should be understood that a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of this invention.

We claim:

1. A dual action operating mechanism for a plugboard system or the like to connect and disconnect electrical terminal modules of a front bay with respective electrical terminal modules of a rear bay, comprising:

a rear bay including a frame having top, bottom and side members in which a subframe is mounted to move in a normal direction, said subframe having a plurality of first and second electrical terminal modules each containing first and second terminals respectively, and a coupler mounted on said subframe;

hanger plates mounted onto opposite side members of said rear bay frame in alignment with each other and including guide slots therein, said hanger plates serving to receive in said guide slots thereof support members extending outwardly from respective side members of a frame of a front bay;

sliding cam plates mounted on said rear bay frame and movable along said hanger plates, each cam plate having a front cam surface formed to move said front bay via said support members in a straight inward direction;

each of said cam plates having a first actuator surface, and a second actuator surface which is engageable with said subframe coupler;

an operating member mounted onto said rear bay frame to move said cam plates in unison relative to said hanger plates between an inoperative position, an intermediate position, and an operative position, said operating member including a cam having a bearing means thereon disposed to engage said first actuator surface of said sliding cam plates;

said bearing means movable when said operating member moves said sliding cam plates between said inoperative and intermediate positions in a single motion, so that said support members are positioned in said respective guide slots, said hanger plates are moved into said front cam surface, said sliding cam plates move along said side members of said rear bay frame causing said support members to move along said guide slots in a straight inward direction thereby electrically connecting together ones of said first electrical terminals of said rear bay and associated first terminals in first modules of said front bay and simultaneously moving contact sections of said second rear bay terminals to coextend along corresponding contact sections of associated second terminals in second modules of said front bay; and continued movement of said operating member from said intermediate to said operative position causes said second actuator surface of said sliding cam plate to move said subframe in the normal direction to engage together and electrically connect with preselected contact force said coextending contact sections of said second front and rear bay terminals.

2. A dual action operating mechanism as set forth in claim 1, wherein said rear bay frame further comprising means between said frame and said subframe to bias said subframe to a first position.

3. A dual action operating mechanism as set forth in claim 1, wherein said front cam surfaces have entrance sections, angled sections and straight sections, the entrance sections extending parallel to said guide slots, the straight sections being disposed generally normal to said entrance sections and said angled sections extending between the entrance sections and the straight sections.

4. A dual action operating mechanism as set forth in claim 1, wherein said rear frame defines aligned guide slots located below said hanger plates and respective front cam surfaces are associated therewith.

5. A dual action operating mechanism as set forth in claim 1 wherein first and second recesses are located on said side members of said rear bay frame and wherein said first recess is positioned to receive said hanger plates and wherein said second recess is positioned to receive said sliding cam plate, and wherein said first recess is formed within said second recess.

6. A dual action operating mechanism as set forth in claim 1, wherein said coupler includes arms extending from each subframe side member and said subframe arms are disposed to engage said second actuator surface of said sliding cam plates.

7. A dual action operating mechanism as set forth in claim 1, wherein said first actuator surface comprises a first oblong slot parallel to said guide slots, said second actuator surface comprises a second oblong slot normal to said guide slots, and said bearing means comprise roller bearing means.

8. A dual action operating mechanism as set forth in claim 1, wherein said second electrical terminals include zero insertion force connectors.

9. A dual action operating mechanism as set forth in claim 1, wherein said first electrical terminals include pin and socket electrical connectors.

10. A dual action operating mechanism as set forth in claim 1, wherein said second and first electrical terminals comprise zero insertion force and pin and socket electrical connectors respectively.

11. A dual action operating mechanism as set forth in claim 1, further including at least one said rear by a terminal module having secured therein, ones of male terminals and female terminals matable with other male terminals and female terminals secured in at least one corresponding front bay terminal module, said rear bay terminal module and front bay terminal module including cooperating alignment means to align the modules upon initial engagement during mating, said at least one rear bay module being float mounted to said subframe via an aperture to allow the normal movement of said rear bay frame in relation to at least one rear bay terminal module after connector mating with a corresponding at least one front bay terminal module.

12. A dual action operating mechanism as set forth in claim 1, wherein said operating member includes a shaft extending through each of said side members, and arms secured to said shaft.

13. A dual action operating mechanism as set forth in claim 1, wherein said shaft arms are disposed through arcuate openings formed within said side members to engage said sliding cam plates.

14. A dual action operating mechanism for positioning a front bay member in operative relationship with a rear bay so that associated connecting electrical terminal modules in the front and rear bays can be electrically connected or disconnected when the bays are moved relative to each other comprising:

a rear bay including a frame having top, bottom and side members in which a subframe is mounted to move in a normal direction, said subframe having a plurality of first and second electrical terminal modules each containing first and second terminals respectively, and a coupler mounted on said subframe;

hanger plates mounted onto opposite side members of said rear bay frame in alignment with each other and including guide slots therein, said hanger plates serving to receive in said guide slots thereof support members extending outwardly from respective side members of a front bay frame;

a front bay having a frame including support members on side members of said frame, said support members adapted to be positioned in respective said guide slots of said hanger plates;

sliding cam plates mounted on said rear bay frame and movable along said hanger plates, each said cam plate having a front cam surface formed to move said front bay via said support members in a straight inward direction;

each of said cam plates having a first actuator surface, and a second actuator surface which is engageable with said subframe coupler;

an operating member mounted onto said rear bay frame to move said cam plates in unison relative to said hanger plates between an inoperative position, an intermediate position, and an operative position, said operating member including a cam having a bearing means thereon disposed to engage said first actuator surface of said sliding cam plates;

said bearing means movable when said operating member moves said cam plates between said inoperative and intermediate positions in a single motion, so that said support members are positioned in said respective guide slots, said hanger plates are moved into said front cam surface, said sliding cam plates move along said side members of said rear bay frame causing said support members to move along said guide slots in a straight inward direction thereby electrically connecting together said respective first electrical terminals of said rear bays and associated first terminals in first modules of said front bay, and moving contact sections of said second rear bay terminals to coextend along corresponding contact sections of associated second terminals in second modules of said front bay; and continued movement of said operating member from said intermediate to said operative position causes said second actuator surface of said sliding cam plate to move said subframe in the normal direction to engage together and electrically connect with preselected contact force said coextending contact sections of said second front and rear bay terminals.

15. A dual action operating mechanism as set forth in claim 14, wherein said rear bay frame further comprises means between said frame and said subframe to bias said subframe to a first position.

16. A dual action operating mechanism as set forth in claim 14, wherein said front cam surfaces have entrance sections, angled sections and straight sections, said entrance sections extending parallel to said guide slot, said straight sections being disposed generally normal to said entrance sections and said angled sections extending between said entrance sections and said straight sections.

17. A dual action operating mechanism as set forth in claim 14, wherein said rear frame defines aligned guide slots located below said hanger plates and respective front cam surface are associated therewith.

18. A dual action operating mechanism as set forth in claim 14, wherein first and second recesses are located on said side members of said rear bay frame and wherein said first recess is positioned to receive said hanger plates and wherein said second recess is positioned to receive said sliding cam plate, and wherein said first recess is formed within said second recess.

19. A dual action operating mechanism as set forth in claim 14, wherein said coupler includes arms extending from each subframe side member, and said subframe arms are disposed to engage said second actuator surface of said sliding cam plates.

20. A dual action operating mechanism as set forth in claim 14, wherein said first actuator surface comprises a first oblong slot parallel to said guide slots, said second actuator surface comprises a second oblong slot normal to said guide slots, and said bearing means comprise roller bearing means.

21. A dual action operating mechanism as set forth in claim 14, wherein said second modules include zero insertion force terminals.

22. A dual action operating mechanism as set forth in claim 14, wherein said first modules include pin and socket electrical terminals.

23. A dual action operating mechanism as set forth in claim 14, wherein said second and first front and rear bay modules include therein zero insertion force and pin and socket electrical terminals respectively.

24. A dual action operating mechanism as set forth in claim 14, further including at least one said rear bay terminal module having secured therein ones of male terminals and female terminals matable with other male terminals and female terminals secured in at least one corresponding front bay terminal module, said rear bay terminal module and front bay terminal module including cooperating alignment means to align the modules upon initial engagement during mating, said at least one rear bay module being float mounted to said subframe via an aperture to allow the normal movement of said rear bay frame in relation to at least one rear bay terminal module after connector mating with a corresponding at least one front bay terminal module.

25. A dual action operating mechanism as set forth in claim 14, wherein said operating mechanism includes a shaft extending through each of said side members, and arms secured to said shaft.

26. A dual action operating mechanism as set forth in claim 14, wherein said shaft arms are disposed through arcuate openings formed within said side members to engage said sliding cam plates.

27. A dual action operating mechanism as set forth in claim 14, wherein a safety switch is connected to said rear bay frame which is only in an on position when said operating member is in said operative position.

28. A dual action operating mechanism for a plugboard system or the like to connect and disconnect electrical terminals of a front bay with respective electrical terminals of a rear bay comprising:

first means for moving the front bay relative to the rear bay in a straight inward direction from a first axial position to a second axial position and at a first normal position, thereby electrically connecting first selective electrical terminals of the front and rear bays together by axial mating, and further simultaneously moving second selective electrical terminals of the front bay into coextending but unengaged relationship with second selective electrical terminals of the rear bay; and second means for moving a subframe of the rear bay in a normal direction to a second normal position at the second axial position to move and urge laterally together and thereby electrically connect said coextending second selective electrical terminals of the rear by with the second selective electrical terminals of the front bay under preselected contact force while not disconnecting the first electrical terminals already connected, said first and second moving means sequentially controlled by a single operating member.

29. A dual action operation mechanism as set forth in claim 28, wherein said first electrical terminals are secured in first modules float mounted within said subframe in a manner to maintain electrical connection with the front bay as said subframe moves in a normal direction.

30. A dual action operating mechanism for a plugboard system or the like to connect and disconnect electrical terminals of a front bay with respective terminals of a rear bay comprising:

means for mounting a subframe on the rear bay for movement in a normal direction;

means for mounting first connector modules containing terminals on said subframe for movement in a normal direction with respect to said subframe;

mounting second connector modules containing terminals fixedly on said subframe;

means for axially moving said front bay electrical terminals in electrical connection with said first rear bay electrical terminals, said axial movement also aligning said second rear bay electrical terminals with said corresponding front bay electrical terminals; and means for normally moving said subframe to move said second electrical terminals to a predetermined distance to connect said second electrical terminals with said respective front bay electrical terminals, said first modules floating within said subframe and maintaining electrical connection between first electrical terminals therein and said respective front bay terminals.

* * * * *

UNITED STATES PATENT OFFICE

CERTIFICATE OF CORRECTION

Patent No. 4,984,383 Dated January 15, 1991

Inventor(s) Dale B. Mummey and Brent D. Yohn

It is certified that error appears in the above-identified patent and that said Letters Patent is hereby corrected as shown below:

Claim 3, column 10, line 9 - delete the word "the" and replace with the word --said--.

Claim 3, column 10, line 10 - delete the word "the" and replace with the word --said--.

Claim 3, column 10, line 13 - delete the word "the" and replace with the word --said--. (Two occurrences)

Claim 6, column 10, line 27 - insert --,-- after the word "member".

Claim 11, column 10, line 47 - delete the word "by" and replace with the word --bay--; after "by" delete the word "a".

Claim 16, column 12, line 1 - delete the word "slot" and replace with the word --slots--.

Claim 27, column 12, line 63 - delete the word "on" and replace with the word --ON--.

Claim 28, column 13, line 16 - delete the word "by" and replace with the word --bay--.

UNITED STATES PATENT AND TRADEMARK OFFICE
CERTIFICATE OF CORRECTION

PATENT NO. : 4,984,383

DATED : January 15, 1991

INVENTOR(S) : Dale B. Mummey and Brent D. Yohn

It is certified that error appears in the above-identified patent and that said Letters Patent is hereby corrected as shown below:

Claim 30, column 14, line 12 - before the word "mounting", insert the words --means for--.

Signed and Sealed this

Twenty-ninth Day of October, 1991

*Attest:*

HARRY F. MANBECK, JR.

*Attesting Officer*

*Commissioner of Patents and Trademarks*